United States Patent [19]

Toomey

[11] 4,104,980

[45] Aug. 8, 1978

[54] COLLAPSIBLE ROAD BARRIER

[75] Inventor: John Toomey, Alexandria, Va.

[73] Assignee: Value Engineering Company, Alexandria, Va.

[21] Appl. No.: 807,547

[22] Filed: Jun. 17, 1977

[51] Int. Cl.[2] ..... E01F 13/00

[52] U.S. Cl. ..... 116/63 P; 256/64; 182/155

[58] Field of Search ..... 256/64, 1; 182/155, 182/153; 116/63 P

[56] References Cited

U.S. PATENT DOCUMENTS

| | | | |
|---|---|---|---|
| 213,448 | 3/1879 | Prince | 256/64 |
| 418,938 | 1/1890 | Bogusch | 256/64 |
| 1,794,434 | 3/1931 | Adams | 256/64 |
| 2,573,740 | 11/1951 | Spikings | 182/155 |
| 2,648,761 | 8/1953 | Shamel | 256/64 X |
| 3,490,749 | 1/1970 | Anderson | 116/63 P X |
| 3,687,419 | 8/1972 | Forestal | 256/64 |
| 3,802,667 | 4/1974 | Kanan | 256/64 |
| 3,917,232 | 11/1975 | Lindner | 256/64 |

FOREIGN PATENT DOCUMENTS

| | | | |
|---|---|---|---|
| 1,473,068 | 2/1967 | France | 256/64 |
| 372,618 | 5/1932 | United Kingdom | 182/153 |

*Primary Examiner*—Andrew V. Kundrat

*Attorney, Agent, or Firm*—Birch, Stewart, Kolasch & Birch

[57] ABSTRACT

The present invention is directed to a collapsible road barrier which includes at least one horizontal reflective member which is attached to the upper portion of four supporting legs. The four supporting legs are positioned in pairs with the upper portion thereof hinged together and the lower portion thereof spaced from each other so as to provide support for the horizontal reflective member. The collapsible road barrier also includes a universally collapsible bunk positioned adjacent the lower ends of the supporting legs. The universally collapsible bunk is generally rectangular in shape with each of the four corners of the bunk being attached to one of the supporting legs to provide a surface upon which material such as ballast may be positioned. The collapsible road barrier is readily folded to provide for convenient storage.

11 Claims, 1 Drawing Figure

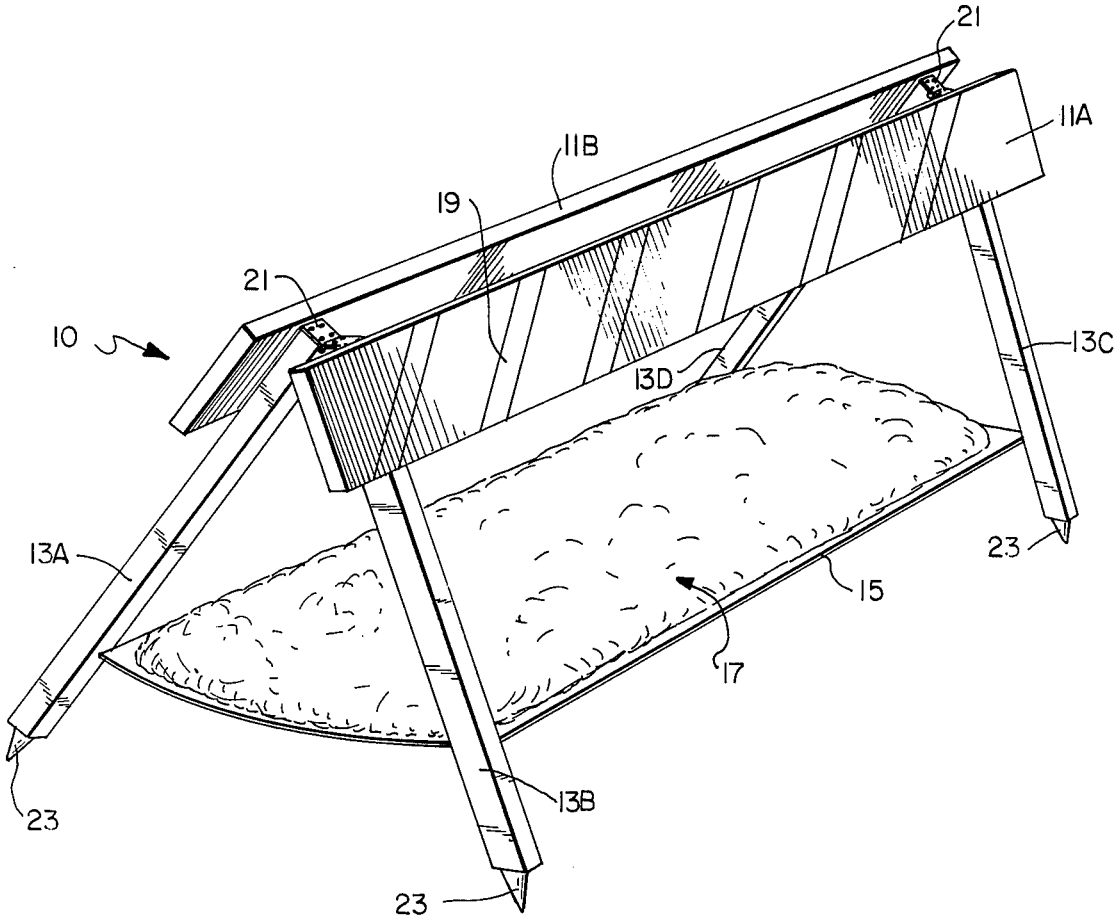
21
11A
11B
19
21
10
13C
13D
13A
23
15
17
23
13B
23

COLLAPSIBLE ROAD BARRIER

BACKGROUND OF THE INVENTION

1. Field of the Invention

The present invention is directed to a readily collapsible road barrier which is light weight in construction and easily assembled adjacent a road surface or any area in which a barrier is desirable. The collapsible road barrier includes a universally collapsible bunk material positioned adjacent the lower portion of the supporting legs which is designed to receive material such as ballast to enhance the stability of the collapsible road barrier.

2. Prior Art

It is conventional to provide a barrier between the portion of a road under construction and the portion of the road which is still suitable for traffic. The type of barrier which is normally used consists of railroad ties which form the base of the barrier and wooden fencing which projects upwardly therefrom. If an individual traveling on the serviceable portion of the road viers into this type of railroad tie road barrier, the vehicle in which he is traveling is normally subjected to severe damage. This damage is directly attributable to the impact of the car against the heavy weight of the railroad tie road barrier.

Another type of road barrrier is constructed of concrete and is substantially prismatic in shape. These concrete road barriers come in lengths of approximately 6 feet and are positioned end-to-end. This type of concrete road barrier possesses the same disadvantages as presented with the railroad tie road barrier discussed above.

Still another type of road barrier is the conventional sawhorse road barrier usually used in combination with at least one sand bag. This type of sawhorse road barrier usually includes a radiant surface and a cross-piece positioned adjacent the lower end of the supporting legs. Normally when using this type of road barrier, a sand bag is positioned over the cross-piece to add additional stability to the sawhorse road barrier. While this type of road barrier overcomes the disadvantages as mentioned above, it adds the additional disadvantage in that the sand bag is difficult to transport and is subject to breaking thus rendering it ineffective.

One prior art patent which is not directed to the same subject matter, but which does disclose some basic similarities to the structure set forth in the present application, is the Spikings patent, U.S. Pat. No. 2,573,740. Spikings patent discloses a carpenter's horse or trestle which includes a folding shelf or tray positioned approximately half way down the supporting legs of the horse. As stated in the Spikings patent, this shelf or tray is designed to hold tools or other articles when the trestle is in the opened upright position. The present invention distinguishes from the Spikings patent in that the present invention is directed to a collapsible road barrier with a universally collapsible bunk position adjacent the lower end of the supporting legs. This universally collapsible bunk is designed to hold material such as ballast adjacent the surface on which the supporting legs are in contact. It is the intent of the present application to provide a road barrier with a low center of gravity to prevent tipping of the barrier when the bunk is filled with ballast. The Spikings patent would not be suitable for use as a road barrier since the tray or shelf does not provide the trestle with a low center of gravity.

SUMMARY OF THE INVENTION

It is an object of the present invention to provide a readily collapsible road barrier which is light weight in construction and therefore prevents excessive damage to a vehicle which may strike the road barrier.

It is another object of the present invention to provide a collapsible road barrier with a horizontal reflective member positioned adjacent the top portion of four supporting legs and a universally collapsible bunk positioned adjacent the lower portion of the supporting legs.

It is still another object of the present invention to provide a collapsible road barrier which is readily folded to provide for convenient storage.

Still another object of the present invention is to provide a collapsible road barrier with a universally collapsible bunk which is substantially rectangular in shape and positioned adjacent the lower ends of the supporting legs to provide a surface on which material such as ballast may be positioned to add stability to the road barrier.

Still a further object of the present invention is to provide a collapsible road barrier with a universally collapsible bunk positioned adjacent the lower ends of the supporting legs so as to produce a low center of gravity when the bunk is filled with material such as ballast.

These and other objects of the present invention are accomplished by constructing a collapsible road barrier with at least one horizontal reflective member which is positioned adjacent the upper portion of four supporting legs. The four supporting legs are positioned in pairs with the upper portion thereof hinged together and a universally collapsible bunk is positioned adjacent the lower ends thereof so as to be stretched between the outwardly projecting supporting legs. When the collapsible road barrier is in the operative position with the supporting legs pivoted outwardly and the bunk stretched therebetween, material such as ballast may be positioned on the bunk to thereby achieve a low center of gravity.

Further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

A better understanding of the invention may be obtained from a consideration of the following detailed description taken in conjunction with the accompanying drawing which is given by way of illustration only, and thus is not limitative of the present invention, and wherein:

The drawing is a perspective view of the collapsible road barrier of the present invention.

DETAILED DESCRIPTION OF THE INVENTION

Referring to the drawing, there is disclosed a collapsible road barrier which includes two horizontal reflective members 11A, 11B positioned adjacent the upper portion of the supporting legs 13A, 13B, 13C and 13D.

The supporting legs are positioned in pairs and hinged at the upper portion thereof by any conventional means, for example, a hinge 21 as shown in the drawing.

The universally collapsible bunk is generally rectangular in shape but may be designed in a variety of different shapes to accommodate different supporting leg designs. As shown in the drawing, the universally collapsible bunk 15 has each of its four corners affixed to one of the supporting legs. The universally collapsible bunk 15 is positioned adjacent the lower portion of the supporting legs so that when material such as ballast is positioned on the bunk, the road barrier will have a low center of gravity. It is to be understood that the collapsible bunk may be made of a variety of different materials such as canvas, plastic or other material which is suitable for the intended purpose.

The collapsible road barrier 10 is designed to be readily folded to permit storage. In the folded condition, the collapsible bunk 15 will also be folded to minimize the space necessary for storage.

In operation, the collapsible road barrier would be unfolded so that the supporting legs 13A, 13B, 13C and 13D are in abuttment with the road surface or ground. In this position, the reflective member 11A and 11B should be substantially horizontal. As the legs are pivoted to their supporting position, the universally collapsible bunk 15 will be stretched therebetween so as to provide a surface on which material such as ballast may be positioned. After the collapsible bunk has been stretched to the open position, material 17 is positioned on the collapsible bunk to add stability to the road barrier. Because the collapsible bunk is positioned adjacent the lower portion of the supporting legs, the collapsible road barrier will have a low center of gravity, thus making it extremely difficult for it to be blown over by the wind.

To enhance the contact between the ground and the supporting legs, a spike 23 may be positioned at the lower most portion of each supporting leg. The spikes 23 will aid in the positioning of the collapsible road barrier 10 when the barrier is used on a surface which may be pierced by the spikes 23.

To enhance the reflectivity of the horizontal reflective members 11A, 11B, it may be desirable to use radiant stripes 19 which are fluorescent in composition so as to readily reflect the headlights of an oncoming vehicle.

One important aspect of the present invention, is to provide a collapsible road barrier in which the collapsible bunk 15 is positioned adjacent the lower most portion of the supporting legs 13A, 13B, 13C and 13D. By positioning the collapsible bunk in this manner, the road barrier will have a low center of gravity when material such as ballast is positioned on the bunk. In addition, because the collapsible bunk is positioned adjacent the lower end of the supporting legs, a vehicle which may vier into a road barrier will not be severely damaged by the impact because the weight of the road barrier is low enough so as not to interfer with the vehicle.

The present invention discloses a collapsible road barrier which may be readily employed adjacent a road surface or other area where a barrier may be desirable. The collapsible road barrier 10 is fully operational with the use of material such as ballast, dirt, bricks, stones, etc. which are readily available on a construction site. By positioning the ballast on the collapsible bunk, the road barrier will be prevented from being tipped over by the wind and will not cause extensive damage to a vehicle which may vier into the road barrier because the ballast, dirt, bricks, stones, etc. are positioned adjacent the ground so as not to interfer with the vehicle.

While the preferred embodiment of the present invention discloses a universally collapsible bunk which is firmly affixed to the supporting legs of a collapsible road barrier, it is to be readily understood that the collapsible bunk may be removably positioned on the supporting legs. In this manner, the collapsible bunk may be readily employed with conventional sawhorse type road barriers by merely attaching each of the four corners of the collapsible bunk to one of the supporting legs of the conventional sawhorse.

In another embodiment of the present invention, the collapsible bunk 15 may be supported from a first rod positioned between supporting legs 13A, 13D and a second rod positioned between supporting legs 13B, 13C. The first and second rods (not shown in the drawing) may be attached to the supporting legs in any conventional manner, but it may be preferable to position the ends of the rods within holes in the supporting legs. By positioning the rods in this manner, the collapsible bunk is readily removable from the collapsible barrier. In addition, this embodiment of the collapsible bunk may be readily employed in combination with a conventional sawhorse by merely drilling four holes in the supporting legs of the sawhorse which will mate with the ends of the first and second rods.

While certain representative embodiments have been shown for the purpose of illustrating the invention, it will be apparent to those skilled in this art that various changes and modifications may be made without departing from the spirit and scope of the invention, and all such modifications as would be obvious to one skilled in the art are intended to be included within the scope of the following claims.

It is claimed:

1. A collapsible road barrier comprising:

at least one substantially horizontal member;

four supporting legs positioned in pairs, each pair being pivotally affixed at an upper end thereof;

said pairs of supporting legs being spaced from each other and affixed at an upper end thereof to said substantially horizontal member;

a collapsible bunk positioned adjacent the lower end of the supporting legs which forms a substantial surface area upon which material such as ballast may be positioned; and said collapsible bunk being flexible so as to readily fold when said collapsible road barrier is stored and to readily return to said substantial surface area when said collapsible road barrier is positioned for use.

2. A collapsible road barrier according to claim 1, herein said flexible, collapsible bunk forms said substantial surface area which extends continuously between said spaced pairs of supporting legs.

3. A collapsible road barrier according to claim 1, wherein said pairs of supporting legs are hinged at the upper end thereof.

4. A collapsible road barrier according to claim 1, wherein substantially horizontal members are positioned on each side of the pivotally joined upper ends of the supporting legs.

5. A collapsible road barrier according to claim 1, wherein each of the supporting legs includes a spike positioned at the lowermost end thereof.

6. A collapsible road barrier according to claim 1, wherein said collapsible bunk is positioned adjacent the lowermost end of the supporting legs so that the road barrier has a low center of gravity when material such as ballast is positioned on the bunk.

7. A collapsible road barrier according to claim 1, wherein said collapsible bunk is universally collapsible.

8. A collapsible road barrier according to claim 1, wherein said at least one substantially horizontal member is a reflective surface.

9. A collapsible road barrier according to claim 1, wherein said collapsible bunk positioned adjacent the lower end of the supporting legs includes rigid support members positioned between said pairs of supporting legs for supporting said collapsible bunk.

10. A collapsible road barrier according to claim 9, wherein said rigid support members positioned between said pairs of supporting legs are rods which mate with holes in the supporting legs.

11. A collapsible road barrier according to claim 4, wherein said substantially horizontal members positioned on each side of the pivotally joined upper ends of the supporting legs are reflective surfaces.

* * * * *